United States Patent [19]

Doland et al.

[11] Patent Number: 4,949,685

[45] Date of Patent: Aug. 21, 1990

[54] INTERNAL COMBUSTION ENGINE WITH ROTARY VALVES

[76] Inventors: George J. Doland; Kevin D. Anton, both of 17400 El Camino Real, Houston, Tex. 77058

[21] Appl. No.: 426,975

[22] Filed: Oct. 25, 1989

[51] Int. Cl.[5] ..... F01L 7/10

[52] U.S. Cl. ..... 123/190 A; 123/190 E; 123/80 BA

[58] Field of Search ..... 123/190 A, 190 E, 190 BB, 123/80 BA

[56] References Cited

U.S. PATENT DOCUMENTS

| | | | |
|---|---|---|---|
| 2,369,147 | 2/1945 | Klas | 123/190 BB |
| 2,714,882 | 8/1955 | Brevard | 123/190 E |
| 2,726,646 | 12/1955 | Black | 123/190 A |
| 2,730,088 | 1/1956 | Hyde | 123/190 A |
| 3,109,623 | 10/1963 | Bryant | 251/172 |
| 3,656,498 | 3/1972 | Grove | 137/312 |
| 3,896,781 | 7/1975 | Smith | 123/190 A |
| 4,019,487 | 4/1977 | Guenther | 123/190 A |
| 4,036,184 | 7/1977 | Guenther | 123/190 A |
| 4,108,196 | 6/1979 | Calvert | 137/72 |
| 4,198,946 | 4/1980 | Rassey | 123/190 A |
| 4,778,148 | 4/1988 | Krüyer | 123/190 E |
| 4,821,692 | 4/1989 | Browne | 123/190 A |

*Primary Examiner*—E. Rollins Cross
*Attorney, Agent, or Firm*—Neal J. Mosely

[57] ABSTRACT

An internal combustion engine with a novel system of rotary valves is disclosed. A conventional engine has a pair of hollow tube rotary valves for each head, one tube being employed as an intake and the other tube as an exhaust. Slots are strategically placed around the circumference of each hollow tube. Each slot has a corresponding port located in the engine cylinder head and the slot passing over this port has a temperature and wear resistant seal that utilizes a wave spring (similar to an oil ring) to compensate for wear. The tubes are sealed on one end which is rotated from the crankshaft using a timing belt mechanism. The opposite end of each tube is fitted into a machined port in the cylinder head for conduction of gases. A carburetor or fuel/air control device is connected to the intake stationary port of the cylinder head. The exhaust system is connected directly to the cylinder port by the exhaust tube. The tubes are sealed to this stationary part with sealing rings. The tubes are positioned to allow a spark plug to be placed vertically between them for better fuel ignition. The seal between the tube and the cylinder which forms the valve is a ceramic alloy and is a close tolerance, thermally stable, wear resistant material. The tube has an extremely hard, close tolerance, ground and polished surface. Since no reciprocating action is involved, and high strength/low friction materials are employed, seals last longer than present valve and valve stem seals.

29 Claims, 2 Drawing Sheets

INTERNAL COMBUSTION ENGINE WITH ROTARY VALVES

BACKGROUND OF THE INVENTION

1. Field of the Invention

This invention relates to new and useful improvements in internal combustion engines and more particularly to engines having rotary intake and exhaust valves.

2. Brief Description of the Prior Art

The concept of a rotary valve in internal combustion engines was present even before 1900. Since then, various rotary valve designs were introduced. Many of the designs were summed up in a book on the subject Although all the designs in this book are now obsolete, the concept of the rotary valve still appears to be superior; however, the practical implementation has not been successful.

The successful implementation of a rotary valve design was as difficult to do back in 1945 as it would have been to develop an animated color graphics screen of a Christmas scene on a home computer. In 1945, not only was the microprocessor/personal computer nonexistent, but neither did a small color CRT exist nor software exist either.

The implementation of a rotary valve design had a similar problem during this time period due to the absence of suitable wear resistant materials. Since 1945, "High Temperature" wear resistant materials have been developed to an amazing extent. These materials maintain very close mechanical tolerances over a wide temperature range. Additionally, the ability to maintain close machining tolerances has improved along with improvements in quality and manufacturing techniques. These improvements make the introduction of a superior rotary valve design possible. It is evident from the patent literature this inventor and others in the U.S.A. are not the only ones still looking at the rotary valve design Although no rotary valve engines have been introduced to the public, in modern automotive engines, recent patents suggest that high interest still exists in this area.

A number of U.S and Foreign patents illustrate the state of the art in the proposed utilization of rotary valves in internal combustion engines.

Klas U.S. Pat. No. 2,369,147 discloses an internal combustion (gasoline) engine having a single rotary sleeve valve with metal-to-metal contact controlling the inlet and exhaust ports.

Brevard U.S. Pat. No. 2,714,882 discloses an internal combustion (gasoline) engine having a rotary sleeve valve with metal seal at the valve ports.

Black U.S Pat. No. 2,726,646 discloses an internal combustion (gasoline) engine having a rotary sleeve valve with metal-to-metal contact at the valve ports.

Hyde U.S Pat. No. 2,730,088 discloses an internal combustion (gasoline) engine having a rotary and reciprocal sleeve valve.

Bryant U.S. Pat. No. 3,109,623 discloses a rotary valve with O-ring seals.

Grove U.S. Pat. No. 3,656,498 discloses a rotary ball valve and seals.

Calvert U.S. Pat. No. 4,108,196 discloses a rotary ball valve and seals.

Rassey U.S Pat. No. 4,198,946 discloses an internal combustion (gasoline) engine having a rotary and reciprocal sleeve valve.

Kruger U.S Pat. No. 4,778,148 (and its counterpart, German Patent No. 3,720,082) discloses an internal combustion (gasoline) engine having a slide valve with a profiled seal.

German Patent No. 518,098 discloses a rotary sleeve valve and metal-to-metal seals in an internal combustion engine.

SUMMARY OF THE INVENTION

It is therefore one object of this invention to provide a new and improved internal combustion engine with rotary intake and exhaust valves.

Another object of the invention is to provide a new and improved internal combustion engine with rotary intake and exhaust valves comprising hollow tube valves.

Another object of the invention is to provide a new and improved internal combustion engine with rotary intake and exhaust valves comprising hollow tube valves with wear compensating sealing rings.

Another object of the invention is to provide a new and improved internal combustion engine with rotary intake and exhaust valves comprising hollow tube valves; slots being placed around the circumference of each hollow tube, each having a corresponding port located in the engine cylinder head and the slot passing thereover having a temperature and wear resistant seal constructed to compensate for wear.

Another object of the invention is to provide a new and improved internal combustion engine with rotary intake and exhaust valves comprising hollow tube valves; slots being placed around the circumference of each hollow tube, each having a corresponding port located in the engine cylinder head and the slot passing thereover having a temperature and wear resistant seal of a ceramic alloy and being a close tolerance, thermally stable, wear resistant material constructed to compensate for wear.

Other objects of the invention will become apparent from time to time throughout the specification and claims as hereinafter related.

The above objects and other objects of the invention are accomplished by a new and improved internal combustion engine with a novel system of rotary valves is disclosed. A conventional engine has a pair of hollow tube rotary valves for each head, one tube being employed as an intake and the other tube as an exhaust. Slots are strategically placed around the circumference of each hollow tube. Each slot has a corresponding port located in the engine cylinder head and the slot passing over this port has a temperature and wear resistant seal that utilizes a wave spring (similar to an oil ring) to compensate for wear. The tubes are sealed on one end which is rotated from the crankshaft using a timing belt mechanism The opposite end of each tube is fitted into a machined port in the cylinder head for conduction of gases. A carburetor or fuel/air control device is connected to the intake stationary port of the cylinder head. The exhaust system is connected directly to the cylinder port by the exhaust tube. The tubes are sealed to this stationary part with sealing rings. The tubes are positioned to allow a spark plug to be placed vertically between them for better fuel ignition. The seal between the tube and the cylinder which forms the valve is a ceramic alloy and is a close tolerance, thermally stable, wear resistant material. The tube has an extremely hard, close tolerance, ground and polished surface. Since no reciprocating action is involved, and high strength/low friction materials stem seals.

DISCUSSION OF THE ROTARY VALVE CONCEPT IN THIS INVENTION

Figures 1, 4:
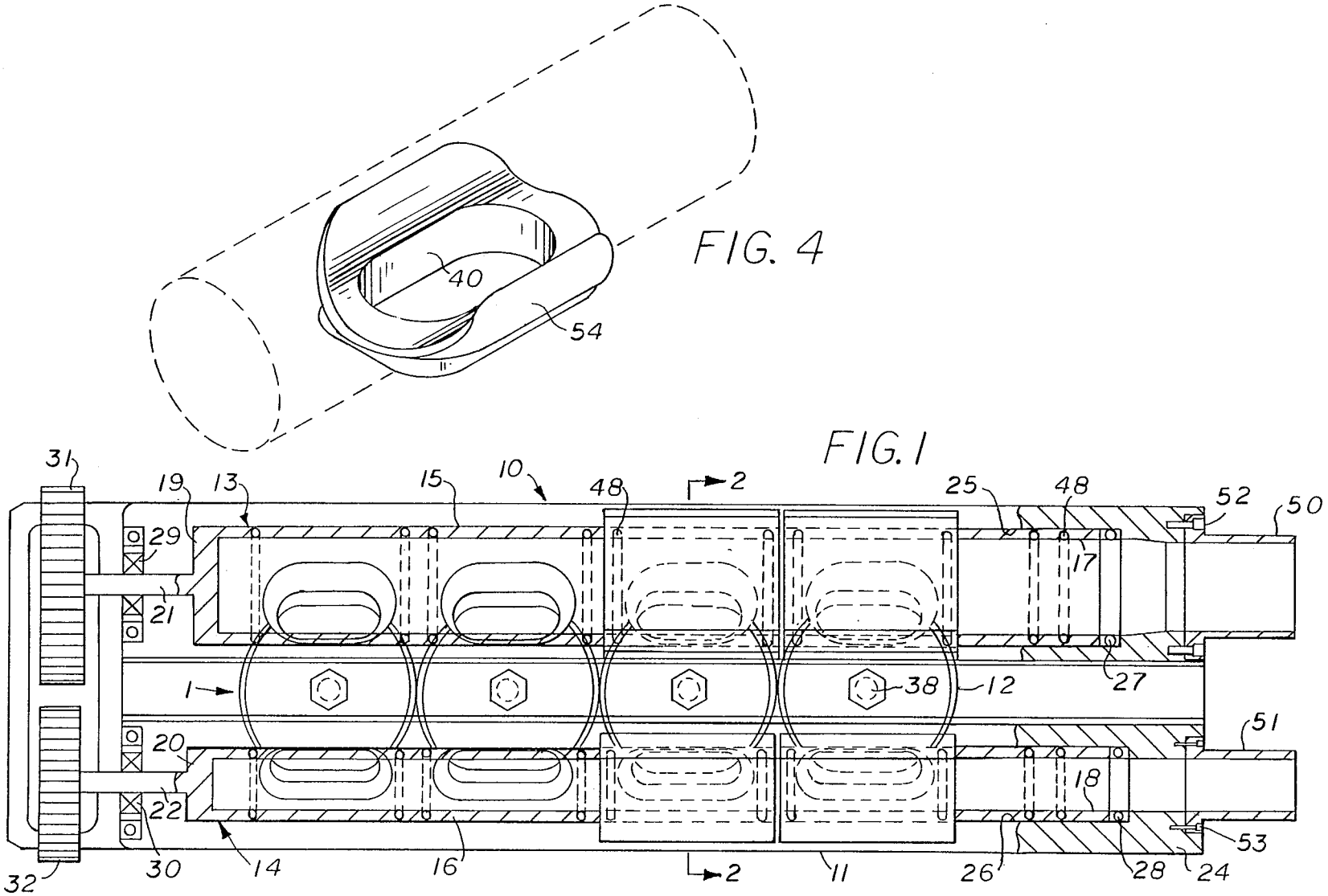
FIG. 1 is a top plan view of an engine with rotary valve members rotated by timing gears and illustrating a preferred embodiment of the invention.
FIG. 4 is an isometric view the rotary valve seal.

The concept of a rotary valve was present even before 1900. Since that time and for the next half of the century various rotary valve designs were introduced. Many of the designs were summed up in a book on the subject (Rotary Valve Engines by Hunter, John Wiley & Sons, Inc. 1946). Although all the designs in this book are now obsolete, the concept of the rotary valve still appears to be superior; however, the practical implementation has not been successful.

The successful implementation of a rotary valve design was as difficult to do back in 1945 as it would have been to develop an animated color graphics screen of a Christmas scene on a home computer. In 1945, not only was the microprocessor/personal computer nonexistent, but neither did a small color CRT exist In addition to these problems no software existed either.

The implementation of a rotary valve design had a similar problem during this time period due to wear resistant materials. Since 1945, "high temperature" wear resistant materials have been developed to an amazing extent. These materials maintain very close mechanical tolerances over a wide temperature range. Additionally, the ability to maintain close machining tolerances has improved along with improvements in quality and manufacturing techniques.

These improvements make the introduction of a superior rotary valve design possible. Although no rotary valve engines have been introduced to the public, in modern automotive engines, recent patents suggest that high interest still exists in this area.

This invention uses the standard engine head layout as much as possible in its rotary valve design implementation. It employs a "Dual Tube" process for each head. One tube is employed as an intake and one tube as an exhaust. Both resilient and spring loaded wear compensating seals are used in the design. The need for wear compensating seals is similar to the need for wear compensating piston rings employed in modern engines. As an engine is used, the sliding of the piston rings on the cylinder wall wears both the cylinder wall and the piston rings. The expansion of a piston ring within the land compensates for this wear. A similar wear compensation technique is used herein to improve sealing in the rotary valve design.

It has been intuitively thought that the rotary valve will have improved performance over existing poppet valve designs. This is due to less restriction in the flow stream allowing easier breathing an a reduced number of moving parts requiring lower horsepower overall to drive the valve train than the conventional poppet valve designs do.

From a theoretical standpoint, the rotary valve design is far superior to that of a poppet valve in terms of air capacity. This increase in air capacity is primarily due to the fact that the largest restriction in a normal poppet valve design is around the valve itself. This limits the overall air capacity and volumetric efficiency in the engine. This invention provides for a rotary valve system employing a nonrestricted and much larger opening in the area of the valve, increasing the air capacity of the cylinders. The increased air capacity in turn increases the volumetric efficiency of the engine. This produces a superior engine design with fewer mechanical parts and, therefore, an increased lifetime.

The following discussion will be limited to the application of the rotary valve design to automobile and marine engines with single cylinders, although the actual application is primarily in the multiple cylinder type. Component speeds, emissions, and fuel efficiency will be considered; however balance and cylinder interactions will not. It should be noted that vibration is reduced. Less crankshaft horsepower is required to operate the valves, thus reducing or eliminating the high frequency harmonics caused by the valve train.

The indicated efficiency, reliability and fuel economy for a non-supercharged, four (4) cycle, spark ignition passenger vehicle engine is related to the piston speed and valve train performance. The bore and stroke are approximately equal in these applications. High piston speeds are encountered in performance automotive and marine applications. When large bore-to-stroke ratios are used, the limit on piston speed is imposed by the valve gear. In order to understand the effects of the valve train on piston speed, the valve-gear characteristic speed is defined as:

$$S_v=[(s)\ (b/st)/Ni^{0.5}$$

Where

Sv = valve-gear Characteristic speed s = Mean piston speed b = Cylinder bore size st = Piston stroke length Ni = Number of inlet or exhaust valves per cylinder, whichever is less.

The average values for this characteristic speed have increased from just over 2000 feet/minute to over 3000 feet/minute in the normal passenger automobile. The advent of "clean" intake designs and overhead cam head designs have pushed the value to over 4000 ft/min. Higher values for Sv provide for larger values of piston speed. Since maximum engine speed does not occur very often in normal passenger autos and high piston speed provides for smaller engine designs, it is desirable to use the highest practical piston speed. A redefinition of this characteristic will naturally be developed as more RPM valve designs are employed since its design has very little effect on maximum piston speed (see The Internal Combustion Engine in Theory and Practice, Vol. 2, page 384, C. F. Taylor, The M.I.T. Press, revised 1985).

Assuming a typical passenger automobile or marine application, there is very little or no valve overlap. Since this invention uses separate tubes are used for intake and exhaust, there is very little heat transfer between them and there is very little heat transfer in the intake from the engine Air capacity is a measure of engine ability to breath. It assumes full throttle operation which is somewhat typical in marine applications.

Major passenger automobile specifications, such as horsepower and maximum torque, are measured at full throttle. As shown below the power output for an engine is proportional to its air capacity.

$$P=(J)(Ma)[(F)(Qc)(n)]$$

Where

P=Power output
J=Mechanical equivalent of heat
Ma=Mass flow of dry air per time, (AIR CAPACITY)
F=Fuel-air ratio
Qc=Heat of combustion per unit mass of fuel
n=Thermal efficiency The power output for an engine is based on the number and size of cylinders as well as their air capacity. The ratio of the power output to the size of the engine cylinders is the volumetric efficiency. If volumetric efficiency is based on dry air it can be expressed as follows:

$$Ev=4Ma/[Pa\times Ap\times s]$$

Where

Ev=Volumetric efficiency
Pa=Partial pressure for air
Ap=Piston area
s=Mean piston speed
Ma=Mass flow of dry are per unit time, (Air Capacity)

Volumetric efficiency (Ev) is a measure of engine power output which is independent of size If two engines of the same size but with different volumetric efficiencies are compared, the one with the higher efficiency will have more power output Volumetric efficiency is more completely defined as the measure of the intake and the cylinder's ability to pump air.

Expressed mathematically:

$$Ev=f[(Z)(pe/pi)((aLp)/ug))-(TiCp/FQc)(TcCp/FQc)(F)(Rl\ldots Rn)]$$

Where f=A mathematical function
Z=Inlet Mach index
pe=Exhaust system pressure
pi=Inlet pressure
a=Sonic velocity
L=Stroke
p=Density
u=Inlet viscosity
g=Force-mass-acceleration constant
Ti=Inlet temperature
Cp=Specific heat
F=Fuel air ratio
Qc=Heat of combustion
Tc=Coolant temp. (approx avg. of inlet & out)
Rl. . . Rn=Engine design ratios, which must include the compression ratio and all other ratios necessary to describe the whole gas-flow passage through the engine.

As this equation states, Volumetric efficiency (Ev) is a function of the inlet Mach index (Z). In theory, as the rpm for an engine increases, the Mach index increases As the rpm is increased, the Ev for the engine decreases. This decrease in Ev is due mainly to two mechanisms. One is losses due to heat transfer. The second is losses due to pressure drops across the intake system and valves. The losses due to heat transfer are the predominant factor at low rpm, such as at idle in a passenger auto. The intake losses are predominant at high rpm such as that experienced at extended application of full throttle (see The Internal Combustion Engine in Theory and Practice, Vol. 1, pages 163 and 174, C. F. Taylor, The M.I.T. Press, revised 1985).

This invention maintains a good Ev at low rpm by keeping heat transfer and intake losses to a minimum. This is accomplished by using the two separate tubes as discussed earlier and described with reference to the drawings below. The ceramic alloy seal has a low thermal conductivity value also lowering losses At higher rpm, the RPM design advantages have an even greater effect. The large, short, unrestricted valve openings greatly reduce the effect of intake pressure drop.

This engine design boosts the upper rpm limit of the engine, as stated above, by improved flow and by reduced valve train mechanical speed limits. This is an engine design where Z has less effect on Ev and power output. The engine has a wide power band because the effect of Z is only significant at very extreme flow rates.

The exhaust valve system affects power output also, although not to the same extent as the intake system. Moderate sized exhaust valves provide improvements over poppet valves by reducing the restriction caused by the valve, its stem and guide. Small restricted exhaust valves result in increased residual gases and increased cylinder pressure at the time of intake opening.

This engine is well suited to fuel injection as well as carburetion. Fuel injection, particularly directly into the cylinder, will improve volumetric efficiency (Ev). The pressure drop through the carburetor is eliminated and there is less liquid fuel in contact with the walls of the induction system. Injector designs can provide stratified charges and help with detonation control. Fuel injection will eliminate the low gas flow problem of fuel dropping out that is associated with idle and low end performance in automotive applications.

Emission control for this invention is similar to any spark-ignition engine. It is a compromise between the lean limit and more control of the inlet flow characteristics. These facts allow an expected drop in the lean limit and improved combustion chamber design to control detonation. A three way catalytic converter can be employed to reduce nitrous oxides, unburned hydrocarbons and carbon monoxide.

This invention has superior wear characteristics to a poppet valve because it does not contain wear prone components or extreme forces. It also employs wear resistant designs and components. The engine employs a spring mechanism to provide wear compensation; the spring is "not" subjected to reciprocating action which causes fatigue and failure.

This invention, by eliminating the reciprocating action, also eliminates many components such as the push rod, rocker arm, tappet, intake & exhaust manifolds etc. The reciprocating motion also causes a sliding action. This sliding action provides friction causing wear on the tappets, camshaft, and rocker arms. Hydraulic lifters were developed to compensate for this wear to some degree. This wear and friction is also eliminated.

This invention employs modern pressure lubricated ball/roller and sleeve bearings. The pressurized oil system employed in modern commercial internal combustion engines provides the necessary lubrication. The oil is sealed by silicone or teflon seals such as those found on modern performance valve stem seals. Similar "O" ring type seals are used in pairs on the tube to seal the tube to the stationary head end.

The seal between the tube and the cylinder which forms the valve is a ceramic alloy. This is a close tolerance, thermally stable, wear resistant material. It is sealed to the tube by the constant pressure of a wave spring with pressure supplemented by cylinder gas pressure. The tube has an extremely hard, close tolerance, ground and polished surface. The engine design uses the ceramic seal with spring backing as the sacrificial element in the system. Since no reciprocating action is involved, and the engine employs modern high strength/low friction materials, seals will last for a longer period of time than the present valve and valve stem seals.

The engine utilizes a universal rotary valve design. Considering this versatility many different configurations are possible. Just as with today's poppet valve design, this invention can be optimized for weight, high performance or economy. The current working design is set forth below.

DESCRIPTION OF A PREFERRED EMBODIMENT

Figure 2:
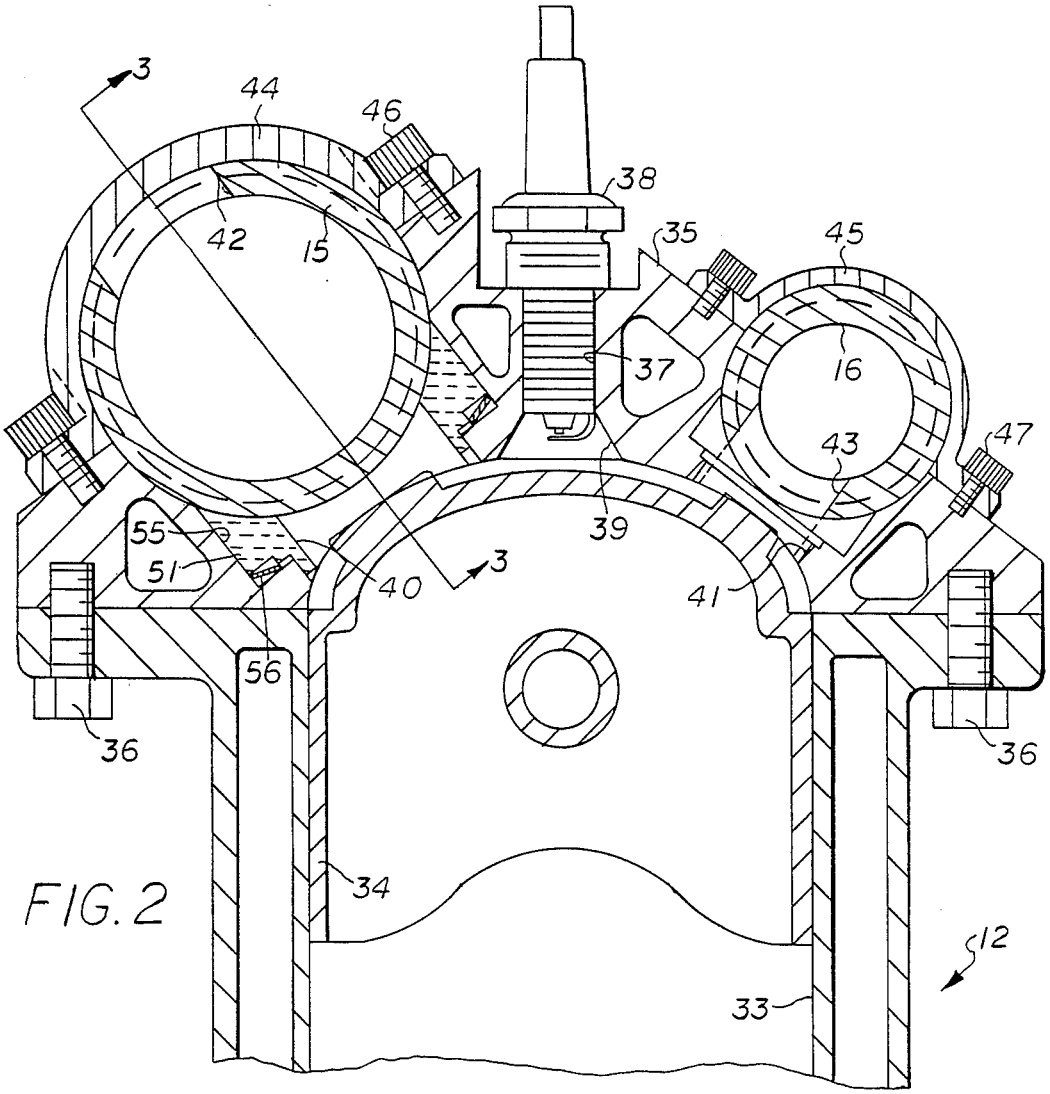
FIG. 2 is a sectional view taken on the line 2—2 of FIG. 1 and showing internal details of the cylinder, piston, and the rotary intake and exhaust valves and seals therefor.
Figure 3:
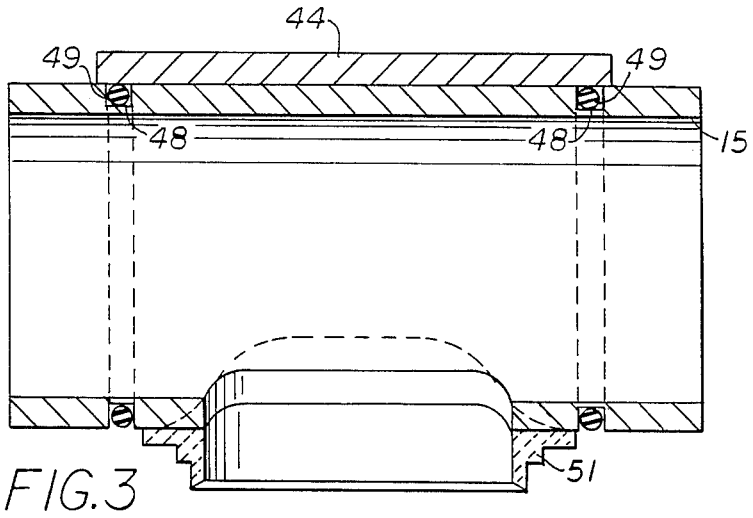
FIG. 3 is a sectional view taken on the line 3—3 of FIG. 2 and showing rotary valve seal in section.

Referring top the drawings by numerals of reference, there is shown (FIG. 1) an internal combustion engine 10, illustrated as a four-cylinder gasoline engine operated by a conventional carburetor (not shown), although the engine can have more or less cylinders and be adapted to fuel injection on gasoline engines or to Diesel engines. The engine block and cylinder head are shown in FIG. 2.

Engine 10 comprises an engine block 11 with four cylinders 12 (FIGS. 1 and 2) with rotary valve tube assemblies 13, for inlet, and 14, for outlet, supported thereon. Tube assemblies 13 and 14 comprise tubes 15 and 16 which have open ends 17 and 18, and closed ends 19 and 20 with rotary shafts 21 and 22 thereon.

Cylinder head 35 has a pair of bosses 23 and 24 at one end with counterbores 25 and 26 which receive the open end portions 17 and 18 of tubes 15 and 16 against end thrust bearings 27 and 28. The closed ends 19 and 20 of tubes 15 and 16 have their shafts 21 and 22 supported in radial bearings 29 and 30. Timing gears 31 and 32 are secured on shafts 21 and 22 and are operable to rotate tubes 15 and 16 in a predetermined timed relation by means of a conventional timing belt (not shown).

An intake fitting 50 is secured to the open end of cylinder head boss 23 by machine screws 52. An exhaust fitting 51 is secured to the open end of boss 24 by machine screws 53. A carburetor or other fuel/air control device (not shown) is connected to the intake fitting 50 and the exhaust system (not shown) is connected directly to the exhaust fitting 51.

Each of the cylinders 12 (FIG. 2) has the usual cylinder cavity 33 in which a piston 34 is positioned for operation. The cylinder and piston shown are for a very high compression engine, but may be of any other suitable design. A removable cylinder head 35 secured in place by machine screws 36. Cylinder head 35 has a threaded opening 37 receiving a spark plug 38 extending into spark cavity 39. Cylinder head 35 has ports 40 and 41 which open into and from the cylinder cavity 33 above the end of piston 34 which provide an inlet for receiving a fuel/air mixture through opening 40 in the intake cycle and exhaust combustion products through opening 41 in the exhaust cycle.

The cylinder head 35 is similar to that used today. It consists of a solid cast piece with finish machining. The combustion chamber shown may be a "semi-hemispherical" or "pent roof" design. This type of design is favored due to advantageous compression ratios. The remaining head components, i.e. water jacket, mounting, covers etc., are similar to any conventional head design.

Tubes 15 and 16 have slots 42 and 43 which are rotated to open and close intake and exhaust ports 40 and 41, respectively, for each of the cylinders 12. Tubes 15 and 16 are secured in place by semicylindrical cap members 44 and 45, one for each cylinder, secured by machine screws 46 and 47 to the respective cylinder heads 35 Cap members 44 and 45 are substantially identical in shape but are sized to fit their respective tubes 15 and 16. The tube caps secured to the cylinder head at each cylinder location prevent flexing of the tubes 14 and 15 as Well as secure sealing of each port assembly.

Tubes 15 and 16 have peripheral grooves 48 in which there are positioned O-rings 49 to provide a gas tight seal on opposite sides of slots 42 and 43 at each of cylinders 12 and at the open end portions 19 and 20 adjacent to end thrust bearings 27 and 28. The surface of tubes 15 and 16 is preferably undercut slightly between grooves 48 under each of the cap members 44.

The intake port 40 to cylinder 12 is protected from wear by a ceramic alloy valve insert member 54. Cylinder head 35 has a counterbore 55 in which ceramic insert member 51 is positioned and pressed against the surface of tube 15 by wave spring washer 56. Insert member 51 is a close tolerance, thermally stable, wear resistant ceramic material, such as AMALOX. It is sealed to the tube 15 by the constant pressure of wave spring 56 with pressure supplemented by cylinder gas pressure The tube 15 is preferably made of chrome-plated, high-tensile steel, or a stainless steel alloy and has an extremely hard, close tolerance, ground and polished surface. This engine design uses the ceramic seal 51 with spring 56 backing as a sacrificial element in the system. Since no reciprocating action is involved, and the engine employs modern high strength/low friction materials, seals will last for a longer period of time than conventional, current valve and valve stem seals.

Rotary tube 16 is protected from wear by a ceramic alloy valve insert member 51 sized to fit the smaller diameter surface of tube 16. The remaining structure, counterbore 55 and spring washer 56 is the same as described above but sized to fit tube 16 and its exhaust port 41. The materials of construction are as described above for use with tube 15.

The engine utilizes a universal rotary valve design. Considering this versatility many different configurations are possible. Just as with today's poppet valve design, this invention can be optimized for weight, high performance or economy.

OPERATION

While the operation of this engine and rotary valve structure should be apparent from the foregoing description of the component parts and assembly, the operation will be restated for clarity.

The novel engine utilizes a rotary valve design that replaces existing valve assemblies of an internal combustion engine. This design employs slots strategically placed around the circumference of a hollow tube. Each slot will have a corresponding port located in the engine cylinder head. The slot passing over this port will serve to port the gases into or out of the cylinder. It employs a high temperature, wear resistant seal that utilizes a wave spring (similar to an oil ring) to compensate for wear.

As described above, the engine valve system comprises a set of hollow tubes. One tube 15 is for the intake of fuel and the other tube 16 for the exhaust of spent gases. These tubes 15, 16 are designed to replace the valves, push rods, rocker arms, lifters, intake and exhaust manifolds of current poppet valve assemblies. The tubes are sealed on one end which is rotated from the crankshaft using a timing belt mechanism. The opposite end of each tube is fitted into a machined port in a boss on the cylinder head for conduction of gases.

A carburetor or fuel/air control device (not shown) is connected to the intake fitting 50 on the cylinder head. The exhaust system is connected directly to the exhaust fitting by the exhaust tube. The tubes are sealed to the bosses with sealing rings. The tubes are positioned to allow a spark plug to be placed vertically between them for better fuel ignition. The spark plugs may also be located outside.

The slots or openings 42, 43 are spaced on the tubes 15, 16 so that the opening and closing of the intake and exhaust ports is timed for proper sequential firing of the cylinders. The intake and exhaust ports are lined and sealed with a ceramic alloy. These seals are held against the tubes by wave springs. The sealing force of the wave spring is supplemented by gas pressure from the cylinder when the cylinder pressure is higher than atmospheric pressure. The ceramic alloy has excellent temperature and wear characteristics as well as being dimensionally stable.

As the engine rotates, it operates according to the cycle of operation of the particular engine design (e.g. 4-cycle, Diesel, etc.) to draw in a fuel-air mixture, through tube 15 and port 42, compress and fire the mixture, and then exhaust the spent gases through exhaust tube 15 and its port 43. The ceramic valve inserts 51 protect against wear an allow indefinite operation of the engine with occasional replacement of the inserts.

While this invention has been described fully and completely, with emphasis on a single preferred embodiment, it should be understood that, within the scope of the appended claims, the invention may be practiced otherwise that as specifically described herein.

We claim:

1. An internal combustion engine of the type having an engine block with at least one cylinder formed therein and a removable cylinder head therefor, at least one piston member positioned for reciprocal movement in said cylinder, said cylinder having intake and exhaust ports, intake means for communicating fuel or air, or a fuel/air mixture to said cylinder, and exhaust passage means for exhausting combustion products from said cylinder, having an improvement which comprises, a first rotary valve assembly comprising a first hollow tube having a closed end and an open end and a intake valve port in the wall thereof, means securing and sealing said first hollow tube for rotation on said cylinder head, said first hollow tube being positioned with said open end operatively connected and sealed to said intake means, and having said intake port positioned to register with and open said cylinder intake port on rotation to a selected position and to close said cylinder intake port on rotation away from said selected position, a second rotary valve assembly comprising a second hollow tube having a closed end and an open end and a exhaust valve port in the wall thereof, means securing and sealing said second hollow tube for rotation on said cylinder head, said second hollow tube being positioned with said open end operatively connected and sealed to said combustion products exhaust means, and having said exhaust port positioned to register with and open said cylinder exhaust port on rotation to a selected position and to close said cylinder exhaust port on rotation away from said selected position, and timing means operatively connected to said closed ends of said first and said second hollow tubes operable to rotate said tubes to open and close said cylinder intake and exhaust valves at selected intervals.

2. An internal combustion engine according to claim 1 in which said timing means comprises timing gears, one on each of said tubes at the closed ends thereof, said timing gears being drivable in a selected timed relation.

3. An internal combustion engine according to claim 1 in which said cylinder intake and exhaust ports have sacrificial insert members therein with port openings therethrough, said insert members being positioned in said cylinder head and biased into sealing engagement with the surfaces of said tubes.

4. An internal combustion engine according to claim 1 in which said cylinder head has recesses surrounding said intake and exhaust ports, sacrificial insert members positioned in said cylinder head recesses and biased into sealing engagement with the surfaces of said tubes.

5. An internal combustion engine according to claim 3 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

6. An internal combustion engine according to claim 4 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

7. An internal combustion engine according to claim 1 in which said tubes are of a hard, high-temperature, dimensionally stable metal having its outer surface machined to a smooth, low friction surface.

8. An internal combustion engine according to claim 7 in which said tubes are of a chrome-plated, high-temperature steel alloy or a high-temperature stainless steel alloy.

9. An internal combustion engine according to claim 1 in which said cylinder head has semicylindrical surface recesses configured to receive each of said tubes, and said securing means for said tubes comprise semicylindrical members fitting over said tubes and means for securing the same to said cylinder head.

10. An internal combustion engine according to claim 9 in which said semicylindrical members fitting over said tubes have edge flanges abutting said cylinder head, and screw means for securing said edge flanges to said cylinder head.

11. An internal combustion engine according to claim 9 in which said cylinder head semicylindrical surface recesses and said tubes have mating peripheral grooves and O-rings positioned therein for sealing said tubes against leakage, said peripheral grooves and O-rings being spaced apart toward the outer edges of said semicylindrical members to seal said tubes outside said intake and said exhaust ports.

12. An internal combustion engine according to claim 9 in which said semicylindrical members fitting over said tubes have edge flanges abutting said cylinder head, and screw means for securing said edge flanges to said cylinder head, said cylinder head semicylindrical surface recesses and said tubes have mating peripheral grooves and O-rings positioned therein for sealing said tubes against leakage, said peripheral grooves and O-rings being spaced apart toward the outer edges of said semicylindrical members to seal said tubes outside said intake and said exhaust ports.

13. An internal combustion engine according to claim 1 in which said cylinder head has semicylindrical surface recesses configured to receive each of said tubes, and said securing means for said tubes comprise semicylindrical members fitting over said tubes and means for securing the same to said cylinder head, said cylinder intake and exhaust ports have sacrificial insert members therein with port openings therethrough, said insert members being positioned in said cylinder head and biased into sealing engagement with the surfaces of said tubes.

14. An internal combustion engine according to claim 1 in which said cylinder head has semicylindrical surface recesses configured to receive each of said tubes, and said securing means for said tubes comprise semicylindrical members fitting over said tubes and means for securing the same to said cylinder head, said cylinder head has recesses surrounding said intake and exhaust ports, sacrificial insert members positioned in said cylinder head recesses and biased into sealing engagement with the surfaces of said tubes.

15. An internal combustion engine according to claim 13 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

16. An internal combustion engine according to claim 14 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

17. An internal combustion engine according to claim 1 in which said engine block has a plurality of cylinders formed therein, at least one piston member positioned for reciprocal movement in each of said cylinders, each of said cylinders having intake and exhaust ports, intake means for communicating fuel or air, or a fuel/air mixture to each of said cylinder, and exhaust passage means for exhausting combustion products from each of said cylinders.

18. A cylinder head assembly for an internal combustion engine of the type having an engine block with at least one cylinder formed therein, at least one piston member positioned for reciprocal movement in said cylinder, said cylinder having intake and exhaust ports, intake means for communicating fuel or air, or a fuel/air mixture to said cylinder, and exhaust passage means for exhausting combustion products from said cylinder, having an improvement which comprises, a first rotary valve assembly comprising a first hollow tube having a closed end and an open end and a intake valve port in the wall thereof, means securing and sealing said first hollow tube for rotation on said cylinder head, said first hollow tube being positioned with said open end operatively connected and sealed to said intake means, and having said intake port positioned to register with and open said cylinder intake port on rotation to a selected position and to close said cylinder intake port on rotation away from said selected position, a second rotary valve assembly comprising a second hollow tube having a closed end and an open end and a exhaust valve port in the wall thereof, means securing and sealing said second hollow tube for rotation on said cylinder head, said second hollow tube being positioned with said open end operatively connected and sealed to said combustion products exhaust means, and having said exhaust port positioned to register with and open said cylinder exhaust port on rotation to a selected position and to close said cylinder exhaust port on rotation away from said selected position, and timing means operatively connected to said closed ends of said first and said second hollow tubes operable to rotate said tubes to open and close said cylinder intake and exhaust valves at selected intervals.

19. A cylinder head assembly according to claim 18 in which said cylinder head intake and exhaust ports have sacrificial insert members therein with port openings therethrough, said insert members being positioned in said cylinder head and biased into sealing engagement with the surfaces of said tubes.

20. A cylinder head assembly according to claim 18 in which said cylinder head has recesses surrounding said intake and exhaust ports, sacrificial insert members positioned in said cylinder head recesses and biased into sealing engagement with the surfaces of said tubes.

21. A cylinder head assembly according to claim 19 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

22. A cylinder head assembly according to claim 20 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

23. A cylinder head assembly according to claim 18 in which said cylinder head has semicylindrical surface recesses configured to receive each of said tubes, and said securing means for said tubes comprise semicylindrical members fitting over said tubes and means for securing the same to said cylinder head.

24. A cylinder head assembly according to claim 23 in which said semicylindrical members fitting over said tubes have edge flanges abutting said cylinder head, and screw means for securing said edge flanges to said cylinder head.

25. A cylinder head assembly according to claim 23 in which said cylinder head semicylindrical surface recesses and said tubes have mating peripheral grooves and O-rings positioned therein for sealing said tubes against leakage, said peripheral grooves and 0-rings being spaced apart toward the outer edges of said semicylindrical members to seal said tubes outside said intake and said exhaust ports.

26. A cylinder head assembly according to claim 23 in which said semicylindrical members fitting over said tubes have edge flanges abutting said cylinder head, and screw means for securing said edge flanges to said cylinder head, said cylinder head semicylindrical surface recesses and said tubes have mating peripheral grooves and O-rings positioned therein for sealing said tubes against leakage, said peripheral grooves and 0-rings being spaced apart toward the outer edges of said semicylindrical members to seal said tubes outside said intake and said exhaust ports.

27. A cylinder head assembly according to claim 18 in which said cylinder head has semicylindrical surface recesses configured to receive each of said tubes, and said securing means for said tubes comprise semicylindrical members fitting over said tubes and means for securing the same to said cylinder head, said cylinder head intake and exhaust ports have sacrificial insert members therein with port openings therethrough, said insert members being positioned in said cylinder head and biased into sealing engagement with the surfaces of said tubes.

28. A cylinder head assembly according to claim 18 in which said cylinder head has semicylindrical surface recesses configured to receive each of said tubes, and said securing means for said tubes comprise semicylindrical members fitting over said tubes and means for securing the same to said cylinder head, said cylinder head has recesses surrounding said intake and exhaust ports, sacrificial insert members positioned in said cylinder head recesses and biased into sealing engagement with the surfaces of said tubes.

29. A cylinder head assembly according to claim 28 in which said insert members are of a formed ceramic material having a port opening therethrough and configured to fit said cylinder head recesses and to seal the surface of said tubes, and further including spring means in each of said recesses biasing said insert members into sealing engagement with the surfaces of said tubes.

* * * * *